US010683060B2

(12) United States Patent
Henry et al.

(10) Patent No.: US 10,683,060 B2
(45) Date of Patent: Jun. 16, 2020

(54) SUSPENSION-BASED COLLAPSIBLE STRAKES FOR WATERCRAFT AND WATERCRAFT INCLUDING THE SAME

(71) Applicant: HRL LABORATORIES, LLC, Malibu, CA (US)

(72) Inventors: Christopher P. Henry, Thousand Oaks, CA (US); Sloan P. Smith, Calabasas, CA (US); David W. Shahan, Los Angeles, CA (US); Joseph Creecy, Malibu, CA (US); Jeffrey Bowles, Malibu, CA (US); Christopher Swanhart, Malibu, CA (US); Robert Walling, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 16/238,251

(22) Filed: Jan. 2, 2019

(65) Prior Publication Data

US 2019/0270495 A1 Sep. 5, 2019

Related U.S. Application Data

(60) Provisional application No. 62/637,964, filed on Mar. 2, 2018.

(51) Int. Cl.

| | |
|---|---|
| ***B63B 1/22*** | (2006.01) |
| ***B63B 1/04*** | (2006.01) |
| ***B63B 3/24*** | (2006.01) |

(52) U.S. Cl.

CPC ..... *B63B 1/22* (2013.01); *B63B 1/04* (2013.01); *B63B 3/24* (2013.01); *B63B 2001/045* (2013.01)

(58) Field of Classification Search

CPC .... B63B 1/22; B63B 3/24; B63B 1/04; B63B 2001/045; B63B 39/005; B63B 17/0081; B63B 2001/201

See application file for complete search history.

(56) References Cited

U.S. PATENT DOCUMENTS 3,998,176 A * 12/1976 Stout ..... B63B 1/22 114/283
4,058,077 A * 11/1977 Johansson ..... B63B 39/061 114/283

(Continued)

OTHER PUBLICATIONS

Shimozono et al., "Shock Mitigation of Planing Craft Using the ARES Aft Lifting Body System," 11th International Conference on Fast Sea Transportation, FAST 2011, Honolulu, Hawaii, Sep. 2011, 4 pages.

(Continued)

*Primary Examiner* — Anthony D Wiest

(74) *Attorney, Agent, or Firm* — Lewis Roca Rothgerber Christie, LLP

(57) ABSTRACT

A watercraft includes a hull having inner and outer surfaces and at least one collapsible strake coupled to the hull. The collapsible strake includes a movable skin hingedly coupled to the hull. The collapsible strake also includes a dampening element and a negative stiffness element each extending from an inner surface of the movable skin to the outer surface of the hull. The movable skin is configured to rotate between an uncollapsed configuration having a first stiffness and a collapsed configuration having a second stiffness greater than the first stiffness.

17 Claims, 8 Drawing Sheets

(56) References Cited

U.S. PATENT DOCUMENTS

| | | | | |
|---|---|---|---|---|
| 4,655,157 | A * | 4/1987 | Sapp | B63B 1/18 114/283 |
| 5,310,157 | A * | 5/1994 | Platus | F16F 3/026 248/619 |
| 5,390,623 | A * | 2/1995 | Mackaness | B63B 1/22 114/282 |
| 5,474,014 | A | 12/1995 | Russell | |
| 6,158,376 | A | 12/2000 | Vorus | |
| 6,182,596 | B1 | 2/2001 | Johnson | |
| 6,223,674 | B1 | 5/2001 | Wyman et al. | |
| 2004/0083939 | A1 | 5/2004 | Royle | |
| 2007/0151494 | A1 | 7/2007 | Carnevali | |
| 2009/0178602 | A1 | 7/2009 | Gundersen | |

OTHER PUBLICATIONS

Peterson, "Shock Mitigation for High Speed Planing Boats," Coastal Systems Station, Dahlgren Division, Naval Surface Warfare Center, Panama City, FL, Dec. 1998, 6 pages.

Sun et al., "Slamming Loads on a Wedge Elastically Suspended on a Marine Structure," Proceedings of the ASME 2015 34th Intern. Conf. on Ocean, Offshore and Arctic Engineering, Newfoundland, Canada, May 31-Jun. 5, 2015, 10 pages.

Banergee et al., "Compliant Materials for Drag Reduction of High-Speed Submerged Bodies," Defense Science Journal, 55(1): 37-42, Jan. 2005.

Boston Whaler, 320 Outrage Manual, 96 pages, Accessed Apr. 13, 2016.

Coats et al., "Porous Hull Research—Phase 1," Naval Warfare Center Carderock Division, Hydromechanics Department Report, 37 pages, Feb. 2009.

Imlay, "Theoretical Motions of Hydrofoil Systems," Langley, CA, National Advisory Committee for Aeronautics, 1947, 78 pages.

Townsend et al., "High speed marine craft motion mitigation using flexible hull design," Ocean Engineering, 42: 126-134, 2012.

Vorus et al., "Wave Impact Reduction of Planing Boats," University of New Orleans, Aug. 1999, 14 pages.

http://en.ruvsa.com/catalog/ussv_hs/, 2012, 3 pages.

https://ullmandynamics.com/, Accessed Apr. 13, 2016, 3 pages.

https://stidd.com/, Accessed Apr. 13, 2016, 2 pages.

https://shockwaveseats.com/?v=7516fd43adaa, Accessed Apr. 13, 2016, 3 pages.

https://shoxs.com/, Accessed Apr. 13, 2016, 15 pages.

https://shockwaveseats.com/product-category/seats/seat-type/control-pod/?v=7516fd43adaa, Accessed Apr. 13, 2016, 2 pages.

https://shockwaveseats.com/ice/?v=7516fd43adaa, Accessed Apr. 13, 2016, 5 pages.

https://www.skydex.com/case-study/impact-mitigating-boat-decking, Accessed Apr. 13, 2016, 4 pages.

http;://velodynemarine.com/index.html, Accessed Apr. 13, 2016, 5 pages.

http://nauti-craft.com/index.html, Accessed Apr. 13, 2016, 6 pages.

https://www.icemarine.com/our-boats/. Accessed Apr. 13, 2016, 1 page.

http://neboatworks.com/power/Sea-blade-35.php, Accessed Apr. 13, 2016, 2 pages.

* cited by examiner

SUSPENSION-BASED COLLAPSIBLE STRAKES FOR WATERCRAFT AND WATERCRAFT INCLUDING THE SAME

CROSS-REFERENCE TO RELATED APPLICATION(S)

The present application claims priority to and the benefit of U.S. Provisional Application No. 62/637,964, filed Mar. 2, 2018, the entire content of which is incorporated herein by reference.

STATEMENT REGARDING FEDERALLY SPONSORED RESEARCH OR DEVELOPMENT

This invention was made with U.S. Government support under Contract HR0011-13-C-0027 awarded by DARPA-STO. The U.S. Government has certain rights to this invention.

BACKGROUND

1. Field

The present disclosure relates generally to strakes for planing watercraft.

2. Description of the Related Art

Planing watercraft are a type of watercraft in which the weight of the watercraft is predominantly supported by hydrodynamic lift rather than hydrostatic lift. Planing watercraft typically include a high deadrise angle hull (e.g., a deep-V hull having a deadrise angle greater than 24 degrees) to mitigate shock impact during high-speed operation and/or operation in rough sea conditions. Related art planing watercraft also commonly include lifting strakes configured to increase the amount of hydrodynamic lift of the watercraft and thereby reduce the wetted surface area and the frictional drag of the watercraft.

In high-speed watercraft, shock and vibration loads on occupants and/or sensor systems limit the speed and operating conditions of the watercraft. In general, in related art watercraft, there is a tradeoff between a high deadrise angle for reduced shock impact and a low deadrise angle for reduced resistance during high-speed operation.

Additionally, related art planing watercraft may include a variety of different shock mitigation and/or shock absorption devices, such as trim tabs, controllable hydrofoils to control excessive pitch motions, combinations of steps and chines, double hull shock reduction systems that utilize flexible elements between the walls of the double hull, and inflatable catamaran hulls alongside a rigid center hull. Some related art planing watercraft include one or more devices at the seat-to-deck interface for reducing or minimizing shock and vibration transmission to occupants, such as suspension seats, seat pods, multi-person cockpits, suspended decks, and padded decks. Other related art planing watercraft may include suspended pontoons or an ultra-high deep-V hull with air entrapment/ventilation tunnels. However, these shock mitigation and/or shock absorption devices in related art planing watercraft are (1) useful in limited conditions (e.g., high-frequency impulses), (2) increase lightship weight, (3) increase the center of gravity of the watercraft, and/or (4) reduce the useful payload capacity (e.g., by 50%) of the watercraft.

SUMMARY

Aspects of embodiments of the present disclosure are directed to a watercraft. In one embodiment, the watercraft includes a hull having inner and outer surfaces and at least one collapsible strake coupled to the hull. The collapsible strake includes a movable skin hinged to or against the hull. The collapsible strake also includes a dampening element extending from an inner surface of the movable skin to the outer surface of the hull, and a negative stiffness element extending from the inner surface of the movable skin to the outer surface of the hull. The movable skin is configured to rotate the first end between a uncollapsed configuration defining a first deadrise angle and a collapsed configuration defining a second deadrise angle greater than the first deadrise angle. The movable skin is configured to rotate between an uncollapsed configuration having a first stiffness and a collapsed configuration having a second stiffness greater than the first stiffness.

The negative stiffness element may be a buckled beam.

The negative stiffness element may exhibit a non-linear, non-hysteretic cubic-like force versus displacement behavior with a static force offset.

The movable skin in the uncollapsed configuration may define a first deadrise angle and the movable skin in the collapsed configuration may define a second deadrise angle greater than the first deadrise angle.

The first deadrise angle may be 10 degrees or less and the second deadrise angle may be 20 degrees or more.

The collapsible strake may include an elastomeric cover covering the movable skin. The elastomeric cover forms a watertight seal with the hull.

The dampening element may include at least one of a viscous damper, a visco-elastic damper, and a friction damper.

The dampening element may include at least one of elastomeric urethane foam and a synthetic viscoelastic urethane polymer.

The collapsible strake may include a series of collapsible strakes arranged symmetrically about the keel.

Each collapsible strake may comprise a series of identical or non-identical elements along the watercraft length.

The present disclosure is also directed to various embodiments of a collapsible strake for a planing watercraft. In one embodiment, the collapsible strake a movable skin configured to be hinged to a hull of the planing watercraft, a damper coupled to an inner surface of the movable skin, and a negative stiffness element (member) coupled to the inner surface of the movable skin. When the collapsible strake is coupled to the hull of the planing watercraft, the movable skin is configured to rotate between an uncollapsed configuration defining a first deadrise angle and a collapsed configuration defining a second deadrise angle greater than the first deadrise angle.

The first deadrise angle may be 10 degrees (or more or less than 10 degrees), and the second deadrise angle may be 20 degrees or more.

The damper may include at least one of a viscous damper, a visco-elastic damper, and a friction damper. The damper may include at least one of elastomeric urethane foam and a synthetic viscoelastic urethane polymer.

The negative stiffness element may be a buckled beam or mechanically uni-stable mechanism.

The collapsible strake may include an elastomeric cover covering the movable skin. The elastomeric cover forms a watertight seal with the hull when the collapsible strake is coupled to the hull of the planing watercraft.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

The features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

The present disclosure is directed to various embodiments of a collapsible strake for a planing watercraft and various embodiments of a planing watercraft incorporating a collapsible strake. The collapsible strake according to various embodiments of the present disclosure is configured to move from a relatively low deadrise angle configuration to a relatively higher deadrise angle configuration. In the relatively low deadrise angle configuration, the collapsible strake is configured to generate hydrodynamic lift and thereby reduces the wetted surface area of the watercraft and friction drag on the watercraft, which increase the fuel efficiency of the watercraft. Damping and negative stiffness suspension elements inside the collapsible strake are configured to absorb hydrodynamic shocks as the collapsible strake is compressed and moves from the relatively low deadrise angle configuration to the relatively higher deadrise angle configuration. The movement of the collapsible strake into the relatively high deadrise angle configuration is also configured to shed water mass associated with these hydrodynamic shocks. Accordingly, planing watercraft incorporating the collapsible strake of the present disclosure are configured to achieve both high planing efficiency and shock mitigation.

Figure 1A:
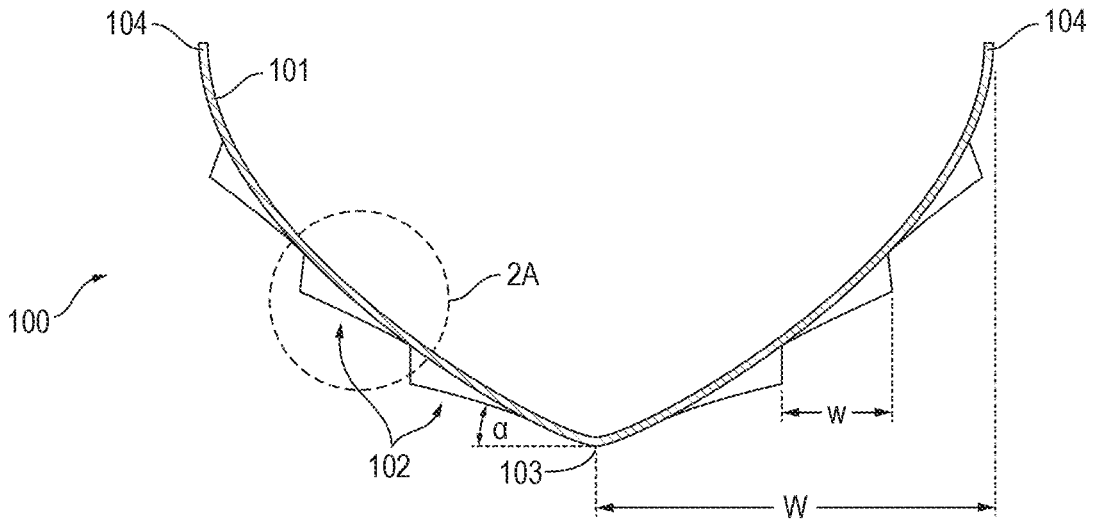
FIGS. 1A-1B are a transverse cross-sectional view and a side view, respectively, of a planing watercraft including a collapsible strake according to one embodiment of the present disclosure.
Figure 1B:
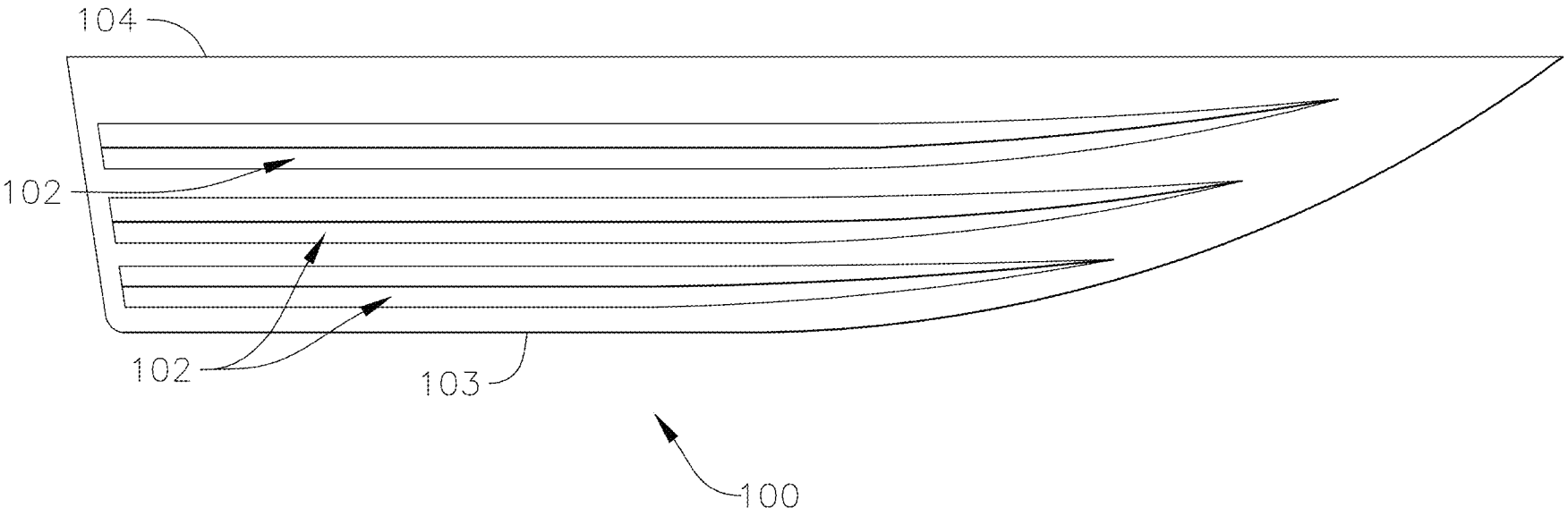

With reference now to FIGS. 1A-1B, a planing watercraft 100 according to one embodiment of the present disclosure includes a hull 101 and at least one collapsible strake 102 coupled to the hull 101. In one or more embodiments, the hull 101 defines a deadrise angle $\alpha$ from 15 degrees to 50 degrees or more (e.g., the planing watercraft 100 has a deep-V hull 101). In one or more embodiments, the deadrise angle of the hull 101 may be any suitable deadrise $\alpha$ angle greater than 24 degrees, depending, for instance, on the design of the planing watercraft 100. Shock mitigation efficacy of the hull design for planing in rough sea conditions is dependent on the magnitude of the hydrodynamic loads the planing watercraft 100 is expected to experience.

In one or more embodiments, the planing watercraft 100 may include a series of collapsible strakes 102 arranged symmetrically about a keel 103 of the hull 101. For instance, in one or more embodiments, the planing watercraft 100 may include from one to six collapsible strakes 102 on each of the port side and the starboard side of the hull 101. In one or more embodiments, each of the collapsible strakes 102 may have a width w in a range from 1% to 30% of a width W of the hull 101 defined from the keel 103 to a chine 104 of the hull 101. For instance, the width w of each of the collapsible strakes 102 may be from 1% to 30% of the keel-to-chine width W of the hull 101. Additionally, in the illustrated embodiment, each of the collapsible strakes 102 is oriented parallel or substantially parallel to the keel 103 of the hull 101. In one or more embodiments, each of the collapsible strakes 102 may extend continuously from the bow to the stern of the hull 101. For instance, each of the collapsible strakes 102 may extend 100% of the overall length of the hull 101. In one or more embodiments, one or more of the collapsible strakes 102 may be divided or segmented into two or more collapsible strake segments oriented end-to-end and extending along a length of the hull 101. For instance, one or more of the collapsible strakes 102 may include a series of longitudinally distributed collapsible strake segments such that the collapsible strake 102 extends discontinuously along the length of the hull 101. In one or more embodiments in which one or more of the collapsible strakes 102 is divided into individual collapsible strake segments, each of the collapsible strake segments may have a length from 1% to 99% of the overall length of the hull 101 (e.g., from 25% to 75% of the overall length of the hull, or from 40% to 60% of the overall length of the hull).

Figure 2A:
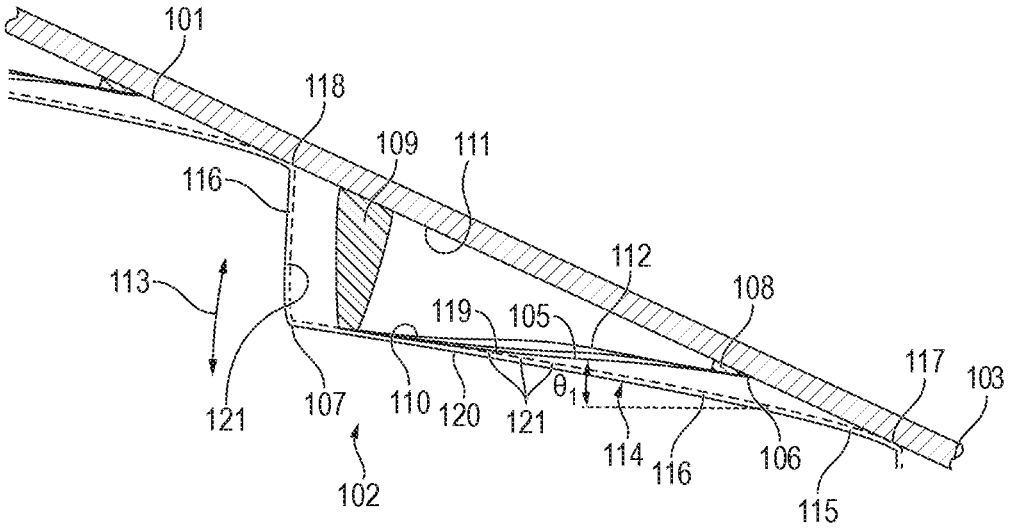
FIGS. 2A-2B are detail views of the embodiment of the collapsible strake illustrated in FIGS. 1A-1B in an uncollapsed configuration and a collapsed configuration, respectively.
Figure 2B:
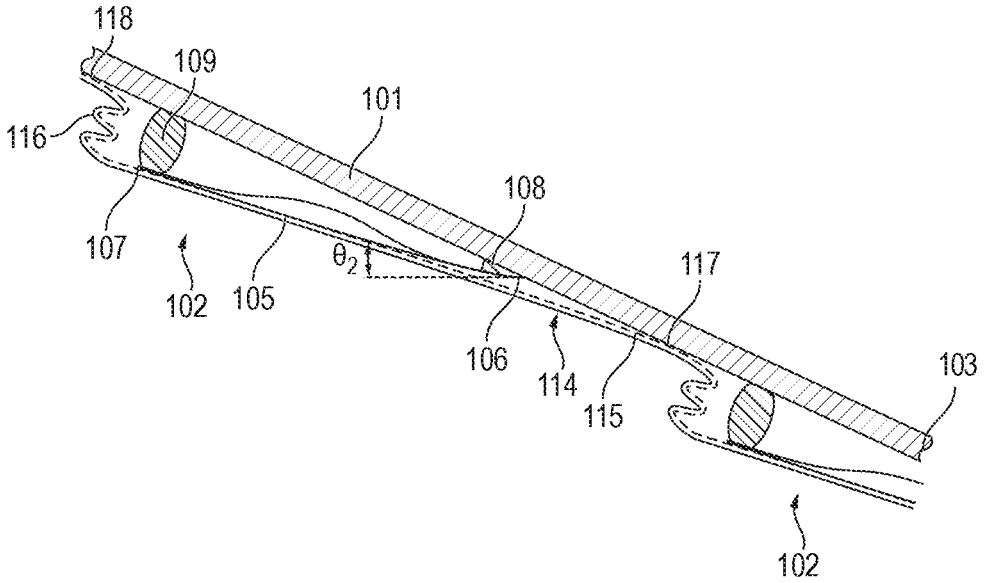

In the embodiment illustrated in FIGS. 2A-2B, each of the collapsible strakes 102 includes a movable skin 105 having a first end 106 (e.g., a first edge) proximate to the keel 103 of the hull 101 and a second end 107 (e.g., a second edge) opposite the first end 106 that is distal to the keel 103. In the illustrated embodiment, the movable skin 105 is hingedly coupled to the hull 101 about the first end 106 of the movable skin 105 by a hinge 108. In the illustrated embodiment, the hinge 108 is a wedge-shaped member coupling the first end 106 of the movable skin 105 to the hull 101 (e.g., a wedge-shaped hinge 108 bonded to the movable skin 105 and the hull 101), although in one or more embodiments the hinge 108 may have any other suitable configuration. In one or more embodiments, the hinge 108 may be a composite hinge. In one or more embodiments, the hinge 108 may be made of any suitable flexible material configured to allow between 1 degree and 45 degrees of rotation and bending up to 14 degrees per linear foot along a lengthwise direction of the movable skin 105.

Additionally, in the illustrated embodiment, the collapsible strake 102 includes at least one damper 109 (e.g., a damping member, dampening element) extending from an inner surface 110 of the movable skin 105 to an outer surface 111 of the hull 101, and at least one negative stiffness element 112 extending from the inwardly facing surface 110 of the movable skin 105 to the outwardly facing surface 111 of the hull 101. In the illustrated embodiment, the negative stiffness element 112 includes a first end proximate to the first end 106 of the movable skin 105 and the hinge 108, and a second end coupled to the movable skin 105 proximate to the second end 107 of the movable skin 105 and the damper 109. In the illustrated embodiment, the damper 109 and the negative stiffness element 112 are in parallel. In one or more embodiments, the damper 109 may be formed of any material having a suitably high damping coefficient, such as a water resistant, synthetic viscoelastic urethane polymer (e.g., elastomeric urethane foam or Sorbothane™). In one or more embodiments, the damper 109 and/or the negative stiffness element 112 may be continuous along the length of the collapsible strake 102 (e.g., from fore to aft along the hull) or the collapsible strake 102 may include a series of discrete negative stiffness elements 112 and/or a series of discrete dampers 109 along the length of the collapsible strake 102.

Figure 6A:
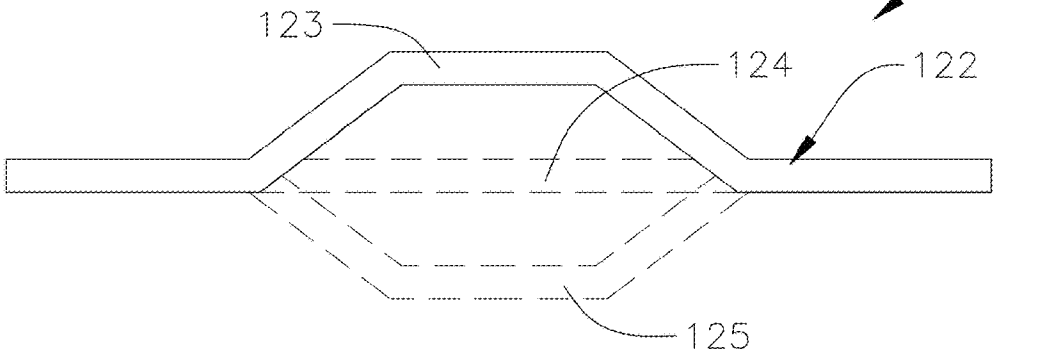
FIGS. 6A-6B are side views of negative stiffness elements according to various embodiments of the present disclosure utilized in the embodiment of the collapsible strake illustrated in FIGS. 1A-1B.
Figure 6B:
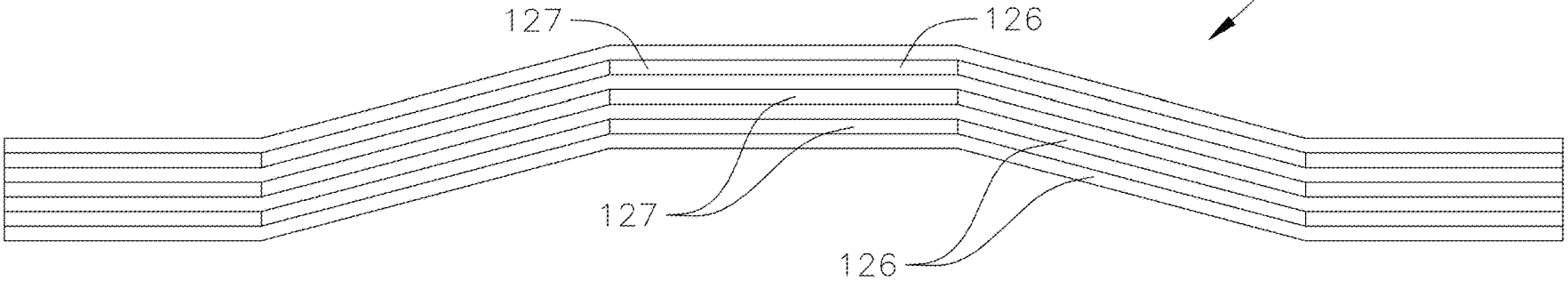

In one or more embodiments, the negative stiffness element 112 is configured to "snap" between a first stable position and a second stable position. Within an envelope defined or bounded by these two stable positions, the negative stiffness element 112 exhibits negative stiffness (i.e., negative stiffness is generated during snap through between the two stable positions). Outside of this envelope bounded by the two stable positions of the negative stiffness element 112, the negative stiffness element 112 exhibits positive stiffness, segment A and D in FIG. 3. The hinge 108, damper 109, and the movable skin 105 may contribute a positive stiffness such that the net stiffness in segment B of FIG. 3. (positive stiffness plus the negative stiffness) is a small but positive value. Accordingly, in one or more embodiments, the negative stiffness element 112 exhibits non-linear stiffness. In one or more embodiments, the negative stiffness element 112 may include one or more buckled beams. For instance, FIGS. 6A-6B depict various embodiments of the negative stiffness element 112. In the embodiment illustrated in FIG. 6A, the negative stiffness element 112 is a single buckled beam 122. In one or more embodiments, the single buckled beam 122 may be formed by preloading the ends of a flat deformable component (e.g., a flat plate), which causes the flat deformable component to deform out of plane and into the buckled shape illustrated in FIG. 6A. When a force is applied to the buckled beam 122, the buckled beam 122 is configured to deform from an upper stable state 123 (shown in solid lines) into an unstable flat state 124 (shown in dashed lines), and when the deformation advances past the unstable flat state 124, the buckled beam 122 is configured to snap into a lower stable state 125 (shown in dashed lines). As the buckled beam 122 is deformed, by the application of a force, towards the flat unstable state 124, the force resisting this deformation decreases until the buckled beam 122 is in the unstable flat state 124, at which point the force is reduced to zero or substantially zero. Further deformation towards the lower stable state 125 illustrated in FIG. 6A results in a force in the direction tending to increase the deformation until the buckled beam 122 is in the lower stable state 125. In the embodiment illustrated in FIG. 6B, the negative stiffness element 112 includes a series of stacked buckled beams 126 (e.g., the negative stiffness element 112 may include two stacked buckled beams, three stacked buckled beams, or four or more stacked buckled beams). In one or more embodiments, adjacent buckled beams 126 may be stacked directly on each other. In one or more embodiments, adjacent buckled beams 126 may be spaced apart from each other by a spacer 127. In one or more embodiments, the one or more buckled beams 126 may be made out of any suitable metal alloy or metal alloys. In one or more embodiments, the negative stiffness element 112 combined with other positive stiffness elements (e.g., the movable skin 105, the cover 114, the hinge 108, the damper 109) exhibits a non-linear, non-hysteretic cubic-like force versus displacement behavior with a static force offset, the significance of which is described below. Suitable negative stiffness elements are described in U.S. Pat. No. 9,394,950, U.S. Pat. No. 9,850,974, and U.S. patent application Ser. No. 10/030,731, the entire contents of each of which are incorporated herein by reference.

The movable skin 105 is configured move (arrow 113) (e.g., rotate) about the hinge 108 at the first end 106 of the movable skin 105 between a relatively low deadrise angle configuration (FIG. 2A) in which the movable skin 105 defines a first deadrise angle $\theta_1$ with respect to a horizontal plane (e.g., a plane of the waterline) and a relatively higher deadrise angle configuration (FIG. 2B) in which the movable skin 105 defines a second deadrise angle $\theta_2$ with respect to the horizontal plane greater than the first deadrise angle $\theta_1$ (e.g., the collapsible strake 102 is configured to move between an uncollapsed configuration in which the movable skin 105 defines the first deadrise angle $\theta_1$, and a collapsed configuration in which the deadrise angle defined by the movable skin 105 is increased to the second deadrise angle $\theta_2$). In one or more embodiments, the first deadrise angle $\theta_1$ defined by the collapsible strake 102 in the uncollapsed configuration may be 10 degrees or less (e.g., 0 degrees or a negative deadrise angle), and the second deadrise angle $\theta_2$ defined by the collapsible strake 102 in the collapsed configuration may be 20 degrees or more. In one or more embodiments, the collapsible strake 102 may define any other suitable deadrise angles $\theta_1$, $\theta_2$ in the uncollapsed and collapsed configurations, respectively, depending on the desired performance characteristics (e.g., hydrodynamic lift and shock mitigation) of the collapsible strake 102.

In the uncollapsed configuration, shown in FIG. 2A, the collapsible strake 102 is configured to generate hydrodynamic lift and thereby reduce the wetted surface area of the watercraft 100 and reduce friction drag on the watercraft 100, which increase the fuel efficiency of the watercraft 100. As described in more detail below, the collapsible strake 102 is configured to move (arrow 113) into the collapsed configuration, shown in FIG. 2B, when the collapsible strake 102 is subject to a force exceeding a threshold force (FIG. 3, point C) that depends, for instance, on the characteristics of the damper 109 and the negative stiffness element 112 (e.g., the collapsible strake 102 is configured to move (arrow 113) into the collapsed configuration when hydrodynamic shocks exceeding a threshold peak intensity are imparted to the collapsible strake 102 during operation of the planing watercraft 100). As the collapsible strake 102 moves (arrow 113) into the collapsed configuration illustrated in FIG. 2B, the movable skin 105 compresses the damper 109. In this manner, the collapsible strake 102 is configured to absorb hydrodynamic shocks and shed water mass associated with these hydrodynamic shocks, thereby mitigating shocks and vibration transmission to the watercraft 100. The movable skin 105 is further configured to accommodate the length change in the water shedding edge of the strake as it collapses between a relatively low deadrise angle configuration and a relatively high deadrise angle configuration to absorb hydrodynamic shocks impacting on the watercraft 100 during operation.

Additionally, as described below in more detail, the positive stiffness of the damper 109, the hinge 108, the movable skin 105 is at least partially offset by the negative stiffness of the negative stiffness element 112, which increases the dynamic response characteristics of the collapsible strake 102 (e.g., the negative stiffness element 112 increases the time responsiveness of the collapsible strake 102). That is, the negative stiffness provided by the negative stiffness element 112 is configured to increase the rate at which the collapsible strake 102 collapses into the relatively high deadrise angle configuration. In one or more embodiments, the time responsiveness of the collapsible strake 102 (e.g., the time responsiveness of the damper 109 and the negative stiffness element 112) is less than 50 ms. In one or more embodiments, the time responsiveness of the collapsible strake 102 may be less than 10 ms. In one embodiment, the time responsiveness of the collapsible strake 102 may be less than 2 ms.

Additionally, in the illustrated embodiment, the collapsible strake 102 is resilient such that the movable skin 105 is configured to return to the uncollapsed configuration when the force (e.g., the hydrodynamic force) applied to the collapsible strake 102 drops below a threshold (e.g., the damper 109, hinge 108, and morphing skin 105 are configured to restore the collapsible strake 102 to the uncollapsed configuration illustrated in FIG. 2A when the force applied to the collapsible strake 102 drops below a threshold).

In the illustrated embodiment, the collapsible strake 102 also includes a cover 114 covering the movable skin 105, the damper 109, and the negative stiffness element 112. In the illustrated embodiment, the cover 114 includes a first segment 115 and a second segment 116 connected to the first segment 115. In the illustrated embodiment, the first segment 115 of the cover 114 extends from a first attachment point 117 along the outer surface 111 of the hull 101 proximate to the first end 106 of the movable skin 105 (e.g., a portion of the hull 101 between the keel 103 of the hull 101 and the first end 106 of the movable skin 105) to the second end 107 of the movable skin 105. The second segment 116 of the cover 114 extends from the second end 107 of the movable skin 105 to a second attachment point 118 along the outer surface 111 of the hull 101. In the illustrated embodiment, the attachment points 117, 118 of the cover 114 form a watertight seal with the hull 101 such that the cover 114 prevents or protects the movable skin 105, the damper 109, and the negative stiffness element 112 from being exposed to the sea water, which might otherwise prematurely wear (e.g., corrode) the movable skin 105, the damper 109, and/or the negative stiffness element 112. In one or more embodiments, the collapsible strake 102 may be provided without the cover 114.

As illustrated in FIG. 2A, the second segment 116 of the cover 114, which extends from the second end 107 of the movable skin 105 to the hull 101, is elongated when the collapsible strake 102 is in the uncollapsed configuration. As the collapsible strake 102 moves (arrow 113) into the collapsed configuration shown in FIG. 2B, the movable skin 105 may rotate about the hinge 108 and compress the damper 109. Alternatively or conjunctively, the second segment 116 of the cover 114 may buckle (e.g., into an accordion-like configuration) or relax from its pretensioned state. In one or more embodiments, the cover 114 may be formed from any suitable elastomeric material configured to allow the cover 114 to flex as the collapsible strake 102 moves between the uncollapsed and collapsed configurations. In one or more embodiments, the cover 114 may be solely an elastomeric coating 120 or include a fiber reinforced plastic (FRP) layer 119 and the coating 120 (e.g., chlorosulfonated polyethylene (CSPE) synthetic rubber (CSM)) on the FRP layer 119. Additionally, in the illustrated embodiment, the cover 114 is perforated (e.g., a series of perforations 121 are defined across the cover 114). The perforations 121 are configured to impart flexibility to the cover 114 and thereby permit the cover 114 to flex as the collapsible strake 102 moves (arrow 113) between the uncollapsed and collapsed configurations.

Figure 3:
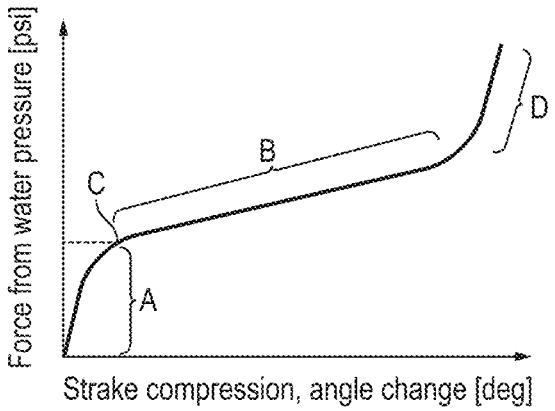
FIG. 3 is a graph depicting deadrise angle change characteristics of the collapsible strake as a function of the water pressure imparted on the collapsible strake according to one embodiment of the present disclosure.

FIG. 3 is a graph illustrating the compression response characteristics of the collapsible strake 102 (e.g., the change in the deadrise angle of the collapsible strake 102) as a function of the water pressure (psi) imparted on the collapsible strake 102. As illustrated in FIG. 3, the collapsible strake 102 exhibits a static load offset region (labelled region "A"), a low (e.g., soft) dynamic stiffness region (labelled region "B"), and a breakover point (labelled "C") at a transition between the static load offset region A and the dynamic stiffness region B. The static load offset region A is exhibited by the collapsible strake 102 in the relatively low deadrise angle configuration (e.g., the uncollapsed configuration illustrated in FIG. 2A). The static load offset region A indicates that the collapsible strake 102 is configured to support a large static load (e.g., the planing loads of the watercraft) without collapsing into the collapsed configuration. The collapsible strake 102 is configured to support a force up to a threshold force corresponding to the breakover point C without collapsing into the collapsed configuration. Accordingly, the collapsible strake 102 is configured to remain in the relative low deadrise angle configuration illustrated in FIG. 2A during calm water planing and maneuvering, which is configured to provide an efficient planing surface for generating hydrodynamic lift and enabling responsiveness of the watercraft 100. Region D is a high stiffness region for the strake in its collapsed configuration.

When the collapsible strake 102 is subject to a force exceeding the threshold force (e.g., a hydrodynamic shock exceeding the threshold force corresponding to the breakover point C), the collapsible strake 102 is configured to collapse (arrow 113) into the collapsed configuration illustrated in FIG. 2B. As the collapsible strake 102 collapses into the collapsed configuration, the collapsible strake 102 exhibits low (e.g., soft) dynamic stiffness and thereby mitigates shock transmission to the hull 101 (by absorbing shock energy and shedding water mass), as illustrated in the low dynamic stiffness region B in FIG. 3. Thus, the breakover point C defines the threshold force at which the collapsible strake 102 transitions from the hydrodynamically efficient static load offset region A in which the collapsible strake 102 has a relatively low deadrise angle configuration, and the shock mitigation-based low dynamic stiffness region B in which the collapsible strake 102 has a relatively higher deadrise angle configuration.

The negative stiffness element 112 in combination with the damper 109 is configured to achieve both energy absorption for shock attenuation and a relatively high mechanical response rate that can respond to impinging waves. The fundamental resonance frequency of the collapsible strake 102, $f_{res}$, is defined as follows:

$$f_{res} = \frac{1}{2\pi}\sqrt{\frac{k_{damp} - k_{neg}}{m}}$$

where $k_{damp}$ is the positive stiffness of the damper 109, $k_{neg}$ is the stiffness of the negative stiffness element 112, and m is the mass of the movable skin 105. As shown in this equation, the positive stiffness of the damper 109 or other element (e.g., the hinge 108 and/or the movable skin 105), which might otherwise contribute to the relatively slow response rate of the collapsible strake 102, is reduced (e.g., at least partially offset) by the negative stiffness of the negative stiffness element 112. In one or more embodiments, the collapsible strake 102 may have a time responsiveness of less than 50 ms. In one or more embodiments, the collapsible strake 102 may have a time responsiveness of less than 10 ms. Additionally, in one or more embodiments, the damping coefficient, $c_{damp}$, of the collapsible strake 102 may be sized as follows:

$$c_{damp} = \frac{\tan\delta}{2}\sqrt{k_{damp} m_{moving}}$$

where tan δ is the loss tangent of the damper 109.

Figure 4A:
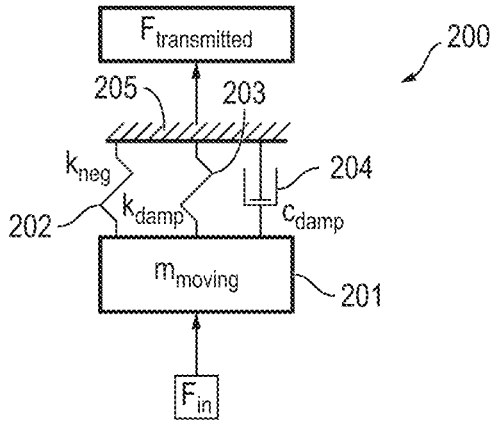
FIG. 4A is a schematic view of a model of the collapsible strake according to one embodiment of the present disclosure.

FIG. 4A illustrates a rigid body collapsible strake model 200 utilized to simulate the dynamic performance of the collapsible strake 102. The rigid body collapsible strake model 200 includes a mass $m_{moving}$ 201 representative of the mass of the movable skin 105, a first spring element $k_{neg}$ 202 representative of the stiffness of the negative stiffness element 112, a second spring element $k_{damp}$ 203 in parallel with the first spring element $k_{neg}$ 202 representative of the positive stiffness of the damper 109, and a damping element $c_{damp}$ 204 representative of the damping of the damper 109. The first and second spring elements 202, 203 and the damping element 204 are each connected at opposite ends to the mass $m_{moving}$ 201 and a rigid member 205, which is representative of the hull 101 of the watercraft 100. The rigid body strake model 200 illustrated in FIG. 4A also depicts a force $F_{in}$ input to the mass $m_{moving}$ 201, which is representative of the hydrodynamic forces acting on the collapsible strake 102 (e.g., due to impinging waves), and the force $F_{transmitted}$ transmitted from the rigid member 205, which is representative of the force transmitted to the hull 101 of the watercraft 100.

Figure 4B:
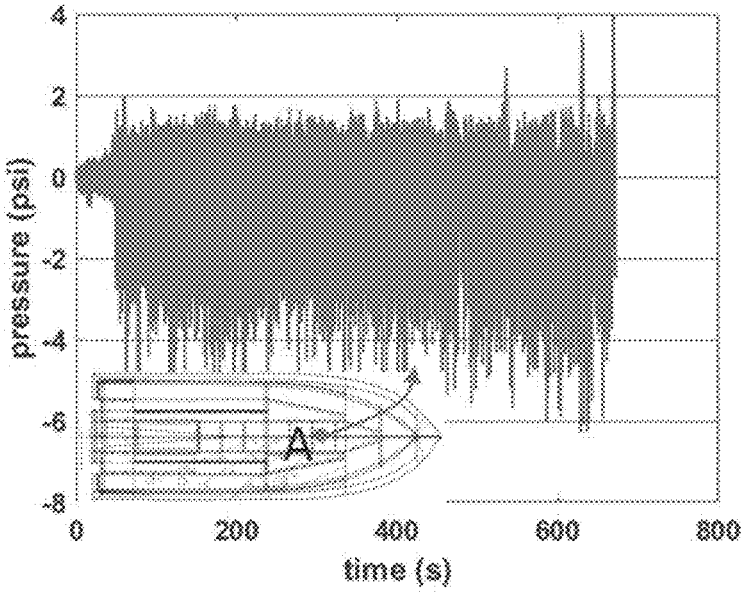
FIG. 4B is a graph depicting input pressure (psi) imparted on the planing watercraft operating in head seas at 30 kts.

FIG. 4B is a graph depicting the force imparted on a watercraft (e.g., a boat) over a period of 700 seconds due to hydrodynamic forces acting on the watercraft (e.g., waves impinging on the watercraft). This input pressure data was obtained from a test boat operating in head seas at 30 knots (kts) in Sea State 2 wave conditions on the Douglas Sea Scale (e.g., waves having a height from 0.1 m to 0.5 m (4 in to 20 in)). As illustrated in FIG. 4B, the pressure data was obtained from a pressure tap located at a position labeled "A" in the boat (e.g., the pressure data was obtained from a pressure tap located at a point along the keel of the boat). Additionally, in FIG. 4B, the pressure data was captured at a frequency of 20 kHz.

Figure 4C:
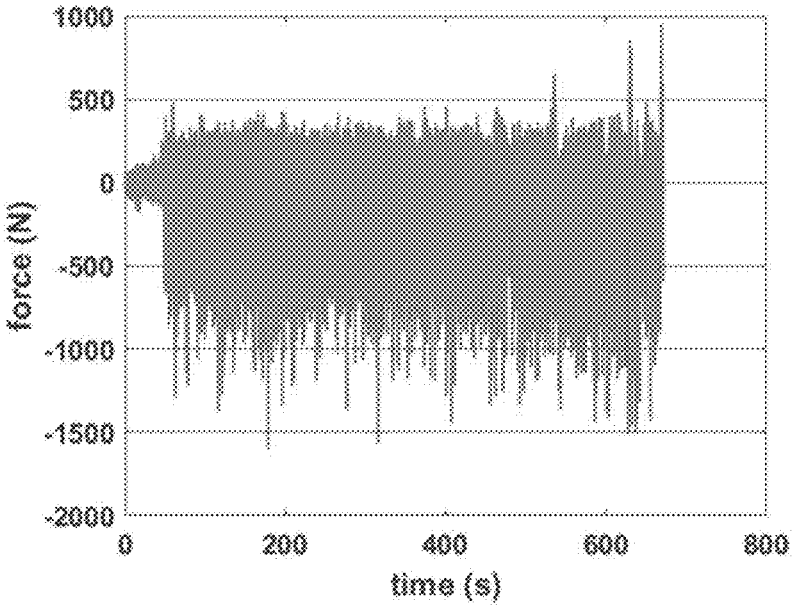
FIG. 4C is a graph depicting the force transmitted by the collapsible strake when the input pressure illustrated in FIG. 4B is applied to the collapsible strake model illustrated in FIG. 4A.

FIG. 4C is a graph depicting the output force $F_{transmitted}$ transmitted by the collapsible strake model 200 illustrated in FIG. 4A when the input pressure data illustrated in FIG. 4B is applied as the input pressure $P_{in}$ to the collapsible strake model 200 illustrated in FIG. 4A. The output force data illustrated in FIG. 4C assumes that the movable skin 105 of the collapsible strake 102, represented by the mass $m_{moving}$ 201 of the collapsible strake model 200 depicted in FIG. 4A, has a size of 3 in by 18 in. In one or more embodiments, a length to width ratio of the strake segments may follow or approximately follow the projected stagnation line angle, which may be determined in calm water.

Figure 5A:
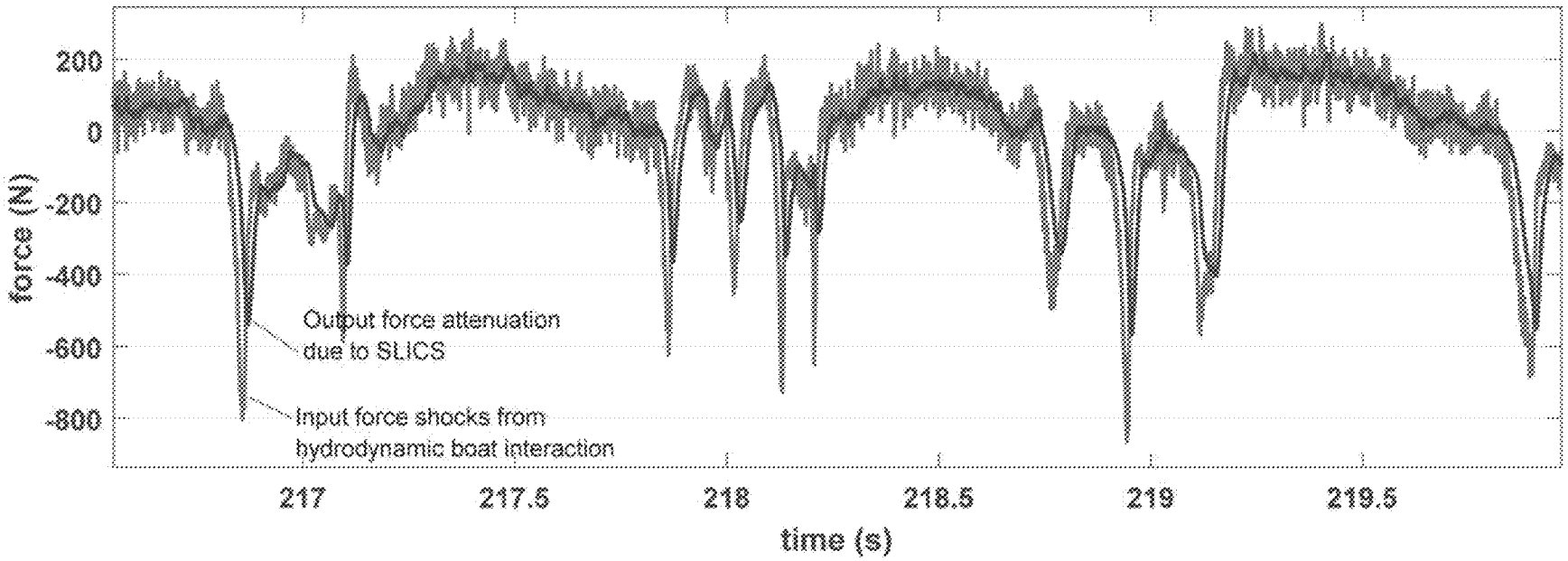
FIG. 5A is a graph depicting input forces imparted to the collapsible strake model and attenuated output forces transmitted by the collapsible strake model.

FIG. 5A is a graph illustrating the force input to the collapsible strake model 200 illustrated in FIG. 4A and the force transmitted by the collapsible strake model 200 over a time period from 216.5 seconds to 220 seconds. As illustrated in FIG. 5A, the collapsible strake reduced the magnitude of the input forces. For instance, the collapsible strake reduced the magnitude of the peak at 216.8 seconds from 800 N to 500 N, and reduced the magnitude of the peak at 217.1 seconds from 600 N to 400 N. Accordingly, the collapsible strake of the present disclosure is configured to attenuate hydrodynamic shocks and mitigate the transmission of those hydrodynamic shocks to the hull of the watercraft.

Figure 5B:
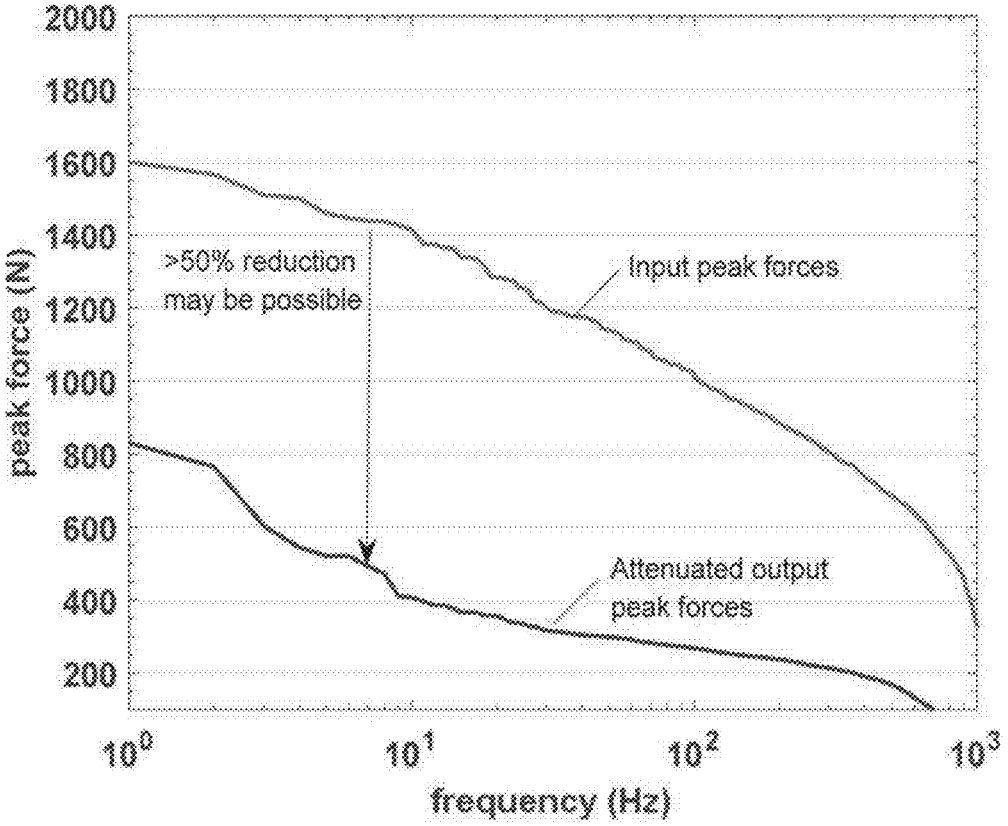
FIG. 5B is a graph depicting input peak forces imparted to the collapsible strake model and attenuated output peak forces transmitted by the collapsible strake model.

FIG. 5B is a graph illustrating the peak input forces acting on the collapsible strake model 200 illustrated in FIG. 4A and the corresponding peak output forces transmitted by the collapsible strake model 200. As illustrated in FIG. 5B, in one or more embodiments, the peak output forces transmitted by the collapsible strake model 200 are less than the corresponding peak input forces acting on the collapsible strake model 200 by 50% or more (e.g., the collapsible strake model 200 attenuates the peak input forces by up to 50% or more).

Figure 5C:
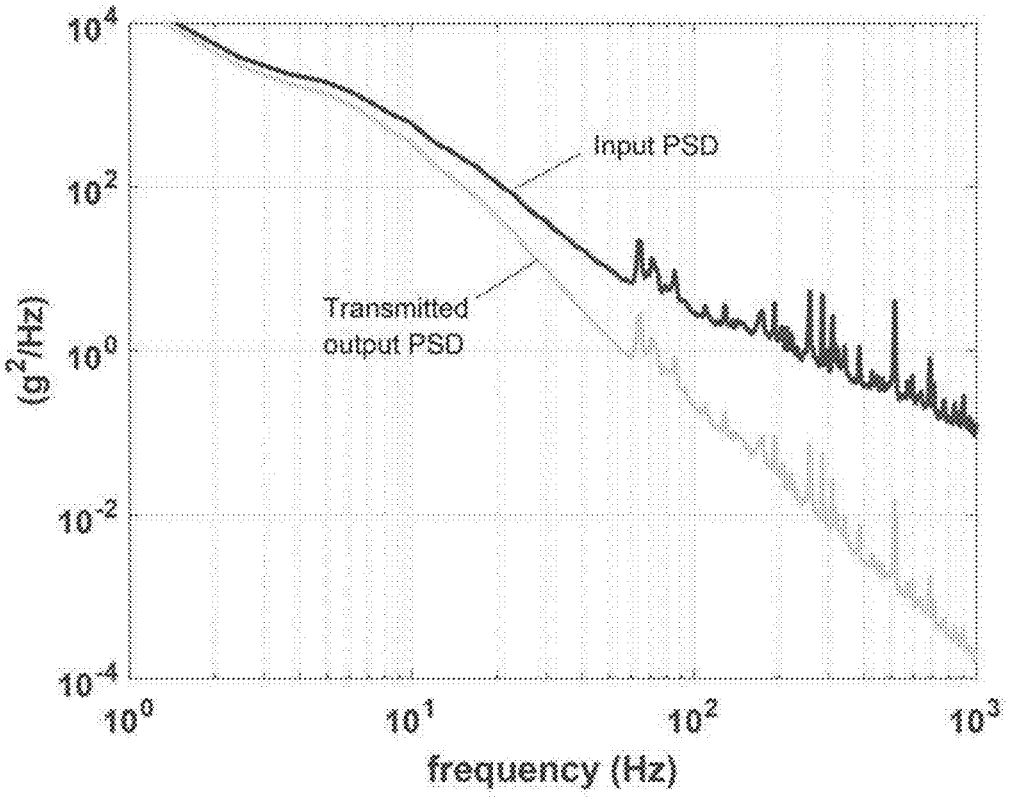
FIG. 5C is a graph depicting the input power spectral density (PSD) imparted to the collapsible strake model and the output PSD transmitted by the collapsible strake model.

FIG. 5C is a graph illustrating the input power spectral density (PSD) imparted on the collapsible strake model 200 illustrated in FIG. 4A and the corresponding output PSD transmitted by the collapsible strake model 200. As illustrated in FIG. 5C, the collapsible strake model 200 is configured to reduce the input PSD imparted on the collapsible strake model 200.

While this invention has been described in detail with particular references to embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention. Although relative terms such as "horizontal," "vertical," "upper," "lower," "inner," "outer" and similar terms have been used herein to describe a spatial relationship of one element to another, it is understood that these terms are intended to encompass different orientations of the various elements and components of the invention in addition to the orientation depicted in the figures. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" or "coupled to" another component, it can be directly on or attached to the other component or intervening components may be present therebetween.

What is claimed is:

1. A watercraft comprising:

a hull comprising inner and outer surfaces; and at least one collapsible strake coupled to the hull, wherein the at least one collapsible strake comprises:

a movable skin hingedly coupled to the hull;

a dampening element extending from an inner surface of the movable skin to the outer surface of the hull; and a negative stiffness element extending from the inner surface of the movable skin to the outer surface of the hull, wherein the movable skin is configured to rotate between an uncollapsed configuration having a first stiffness and a collapsed configuration having a second stiffness greater than the first stiffness.

2. The watercraft of claim 1, wherein the negative stiffness element is a buckled beam.

3. The watercraft of claim 1, wherein the negative stiffness element exhibits a non-linear, non-hysteretic cubic-like force versus displacement behavior with a static force offset.

4. The watercraft of claim 1, wherein the movable skin in the uncollapsed configuration defines a first deadrise angle and the movable skin in the collapsed configuration defines a second deadrise angle greater than the first deadrise angle.

5. The watercraft of claim 4, wherein the first deadrise angle is 10 degrees or less and the second deadrise angle is 20 degrees or more.

6. The watercraft of claim 1, further comprising an elastomeric cover covering the movable skin, the elastomeric cover forming a watertight seal with the hull.

7. The watercraft of claim 1, wherein the dampening element comprises at least one of a viscous damper, a visco-elastic damper, and a friction damper.

8. The watercraft of claim 7, wherein the dampening element comprises at least one of elastomeric urethane foam and a synthetic viscoelastic urethane polymer.

9. The watercraft of claim 1, wherein the at least one collapsible strake comprises a plurality of collapsible strakes arranged symmetrically about a keel of the hull.

10. A collapsible strake for a watercraft, the collapsible strake comprising:

a movable skin configured to be hingedly coupled to a hull of the watercraft;

a damper coupled to an inner surface of the movable skin; and a negative stiffness element coupled to the inner surface of the movable skin, wherein the movable skin is configured to rotate between an uncollapsed configuration having a first stiffness and a collapsed configuration having a second stiffness greater than the first stiffness.

11. The collapsible strake of claim 10, wherein the negative stiffness element is a buckled beam.

12. The collapsible strake of claim 10, wherein the negative stiffness element exhibits a non-linear, non-hysteretic cubic-like force versus displacement behavior with a static force offset.

13. The collapsible strake of claim 10, wherein the movable skin in the uncollapsed configuration defines a first deadrise angle and the movable skin in the collapsed configuration defines a second deadrise angle greater than the first deadrise angle.

14. The collapsible strake of claim 13, wherein the first deadrise angle is 10 degrees or less and the second deadrise angle is 20 degrees or more.

15. The collapsible strake of claim 10, wherein the damper comprises at least one of a viscous damper, a visco-elastic damper, and a friction damper.

16. The collapsible strake of claim 15, wherein the damper comprises at least one of elastomeric urethane foam and a synthetic viscoelastic urethane polymer.

17. The collapsible strake of claim 10, further comprising an elastomeric cover covering the movable skin, wherein the elastomeric cover forms a watertight seal with the hull when the collapsible strake is coupled to the hull of the watercraft.

* * * * *